US007478457B2

(12) United States Patent
Kertz

(10) Patent No.: US 7,478,457 B2
(45) Date of Patent: Jan. 20, 2009

(54) ROTATING DUST WAND

(76) Inventor: M. Glen Kertz, 6476 Calle Del Sol, El Paso, TX (US) 79912

( * ) Notice: Subject to any disclaimer, the term of this patent is extended or adjusted under 35 U.S.C. 154(b) by 50 days.

(21) Appl. No.: 11/422,201

(22) Filed: Jun. 5, 2006

(65) Prior Publication Data

US 2006/0282978 A1 Dec. 21, 2006

Related U.S. Application Data

(60) Provisional application No. 60/687,152, filed on Jun. 3, 2005.

(51) Int. Cl.
*A47L 5/26* (2006.01)
*A47L 9/04* (2006.01)

(52) U.S. Cl. ..... 15/387; 15/344

(58) Field of Classification Search ..... 15/387, 15/344, 377
See application file for complete search history.

(56) References Cited

U.S. PATENT DOCUMENTS

| | | | | |
|---|---|---|---|---|
| 500,415 | A * | 6/1893 | Neal | 15/387 |
| 1,915,073 | A * | 6/1933 | Svensson | 15/387 |
| 2,812,155 | A * | 11/1957 | Woodruff | 415/211.1 |
| 7,059,014 | B2 * | 6/2006 | Martone et al. | 15/387 |
| 7,251,857 | B2 * | 8/2007 | Caruso | 15/377 |

* cited by examiner

*Primary Examiner*—David B Thomas
(74) *Attorney, Agent, or Firm*—Conley Rose, P.C.

(57) ABSTRACT

A dust wand comprising a body and a brush rotatably disposed on the body. A suction chamber is disposed within the body. The suction chamber comprises an inlet port disposed adjacent to an outer edge of the brush and a contacting surface that contacts the outer edge of the brush.

16 Claims, 3 Drawing Sheets

ROTATING DUST WAND

CROSS-REFERENCE TO RELATED APPLICATIONS

This application claims priority to U.S. Provisional Patent Application No. 60/687,152, filed on Jun. 3, 2005 and titled "A Vacuum Assisted Rotating Dust Wand," which is hereby incorporated by reference herein.

STATEMENT REGARDING FEDERALLY SPONSORED RESEARCH OR DEVELOPMENT

Not applicable.

BACKGROUND OF THE INVENTION

The invention relates to methods and apparatus for cleaning, brushing, and vacuuming. More specifically, the invention relates to a rotating dust wand and vacuum attachment.

Historically, there have been many implements used for the removal of household dust. This has included dust cloths, feather dusters, lambs wool dusters, and more recently, synthetic fiber dust wands. These devices rely on the adherent properties of the cloth or brush fiber to collect dust. In the case of brush styled dusters, the dust is collected by an electrostatic charge. The brush fibers carry a slight electrostatic charge that attracts and holds dust particles. While these devices work to some degree, they are not totally effective in collecting dust from either flat or three-dimensional surfaces. Specifically, the action of using a duster in many cases tends to spread the dust rather than collect the dust. In most cases the dust is simply redistributed into the air and settles onto the dusted surface and surrounding areas.

Dust cloths that have been moistened with any cleaning solution, dust removal compound, or other chemical are difficult to use on delicate surfaces or surfaces that will not tolerate any type of moisture or cleaning chemical, e.g. dusting a fine pleated cloth lampshade would not be practical with a moistened dust cloths. Disposable and reusable dust cloths are time consuming and difficult to use on many surfaces. In addition to the labor factor, there is a cost factor to consider with disposable dust cloths and reusable dust cloths must be periodically washed to keep them in a usable state.

Of specific interest is the cleaning of mini-blinds. Over the past 20 years mini-blinds have become increasingly popular in both the home and office settings. Mini-blinds offer a unique cleaning problem as they contain a great many surfaces that collect dust and are difficult to reach due to the very nature of their construction. Using a dust cloth is a very time consuming approach to mini-blind cleaning, as each separate blade of the blind must be individually wiped down. The use of dust wands greatly decreases the labor factor in cleaning mini-blinds but the design of the mini-blind makes it almost impossible to use a dust wand across the surface of the blind with out dislodging previously collected dust.

Thus, the embodiments of the present invention are directed to dust removal and cleaning methods and apparatus that seek to overcome these and other limitations of the prior art.

SUMMARY OF THE PREFERRED EMBODIMENTS

Embodiments of the present invention include a vacuum driven, rotating dust wand/cleaning appliance that attaches to any standard vacuum cleaner hose in such a manner so as to collect dust from a variety of surfaces and deposit the dust in the incoming air flow of the vacuum cleaner. The present invention thus, improves dust collection efficiency, reduces labor and in general provides a better method for cleaning.

The dynamic nature of the rotating brush and the interface of the brush with the air intake/dust collection port provide a self cleaning brush that is electrostatically charged upon each rotation of the brush, thus affording a superior cleaning product. In some embodiments the dust wand comprises a body and a brush rotatably disposed on the body. A suction chamber is disposed within the body. The suction chamber comprises an inlet port disposed adjacent to an outer edge of the brush and a contacting surface that contacts the outer edge of the brush.

Thus, the embodiments of present invention comprise a combination of features and advantages that enable substantial enhancement of cleaning and dust collection. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
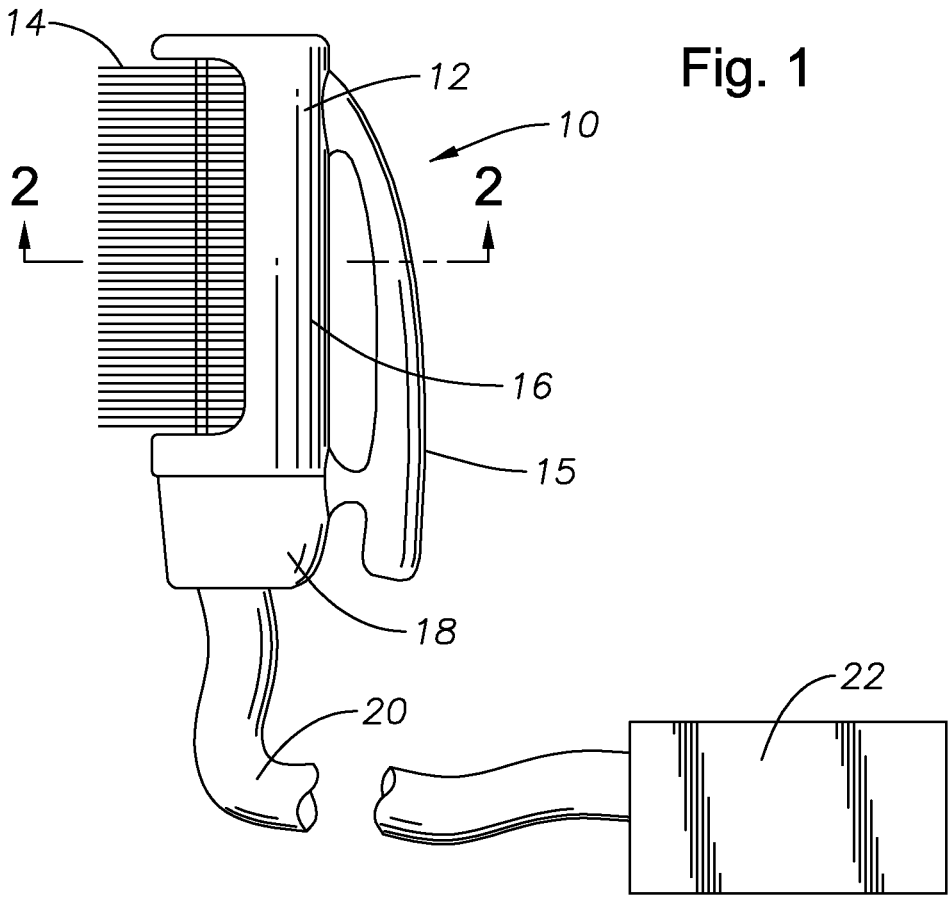
FIG. 1 is a perspective side view showing one side of a rotating dust wand constructed in accordance with embodiments of the present invention.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

FIG. 1 is a side view of rotating dust wand 10 comprising body 12, brush 14, and handle 15. Body 12 further encloses suction chamber 16 and drive system 18. Hose 20 couples dust wand 10 to the air inlet of vacuum cleaner 22. Brush 14 comprises a plurality of bristles constructed from a flexible material that retains an electrostatic charge. Body 12 comprises a material, such as a plastic, that enhances the formation of the electro-static charge on bristles when the bristles contact the body. In operation, drive system 18 rotates brush 14 within body 12. As brush 14 rotates, the bristles of the brush pass in close proximity to suction chamber 16 so that material carried by the brush is removed from the brush and pulled through hose 20 into vacuum cleaner 22.

Figure 2:
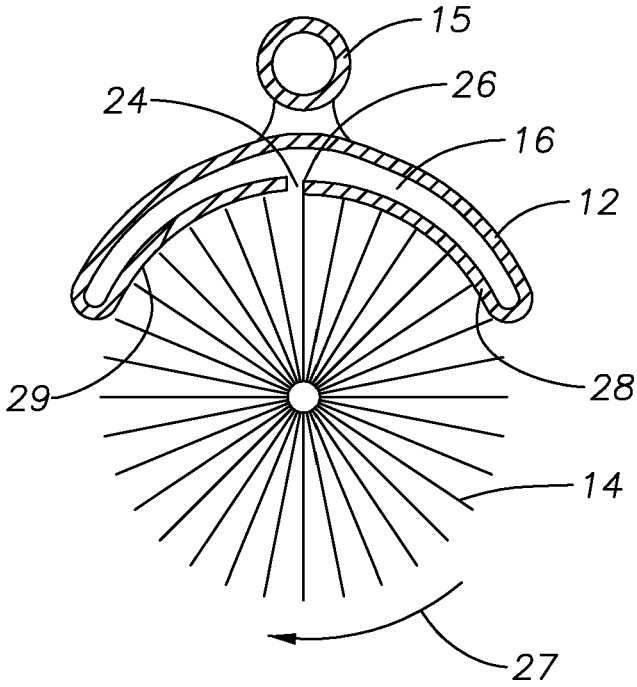
FIG. 2 is a cross-sectional top view of the dust wand of FIG. 1 through the mid-section of the dust wand.

The interaction between brush 14 and suction chamber 16 is shown in FIG. 2, which is a sectional view of dust wand 10 taken through section line 2-2 as shown in FIG. 1. Referring now to FIG. 2, suction chamber 16 further comprises inlet port 24, contacting edge 26, contacting surface 28, and non-contacting surface 29. Inlet 24 provides airflow into suction chamber 16. Contacting edge 26 is slightly extended so that the outer edge of brush 14 contacts edge 26 as the brush rotates, so as to help dislodge material from the brush. Contacting surface 28 has a diameter equal to or slightly smaller than the diameter of brush 14 so that the edge of the brush contacts surface 28. This contact helps generate an electro-static charge that attracts dust particles and other materials to brush 14. Non-contacting surface 29 has a diameter larger than the diameter of brush 14 so that the outer edge of the brush does not contact body 12 until it hits contacting edge 26.

Therefore, as brush 14 rotates in the direction of arrow 27, the brush contacts surface 28 and an electro-static charge is formed on the brush. As brush 14 passes out of housing 12 and in close proximity to dust particles and other materials, the particles are attracted to and retained on the brush by the electro-static charge. The particles are carried into housing 12 by brush 14 where the flow of air into chamber 16 through inlet port 24 pulls the particles off of the brush and into the chamber. The ends of the bristles of brush 14 hit contacting edge 26 as they pass across inlet port 24 to help dislodge any particles still adhered to the brush. Brush 14 then re-engages contacting surface 28 and the cycle restarts.

Figure 3:
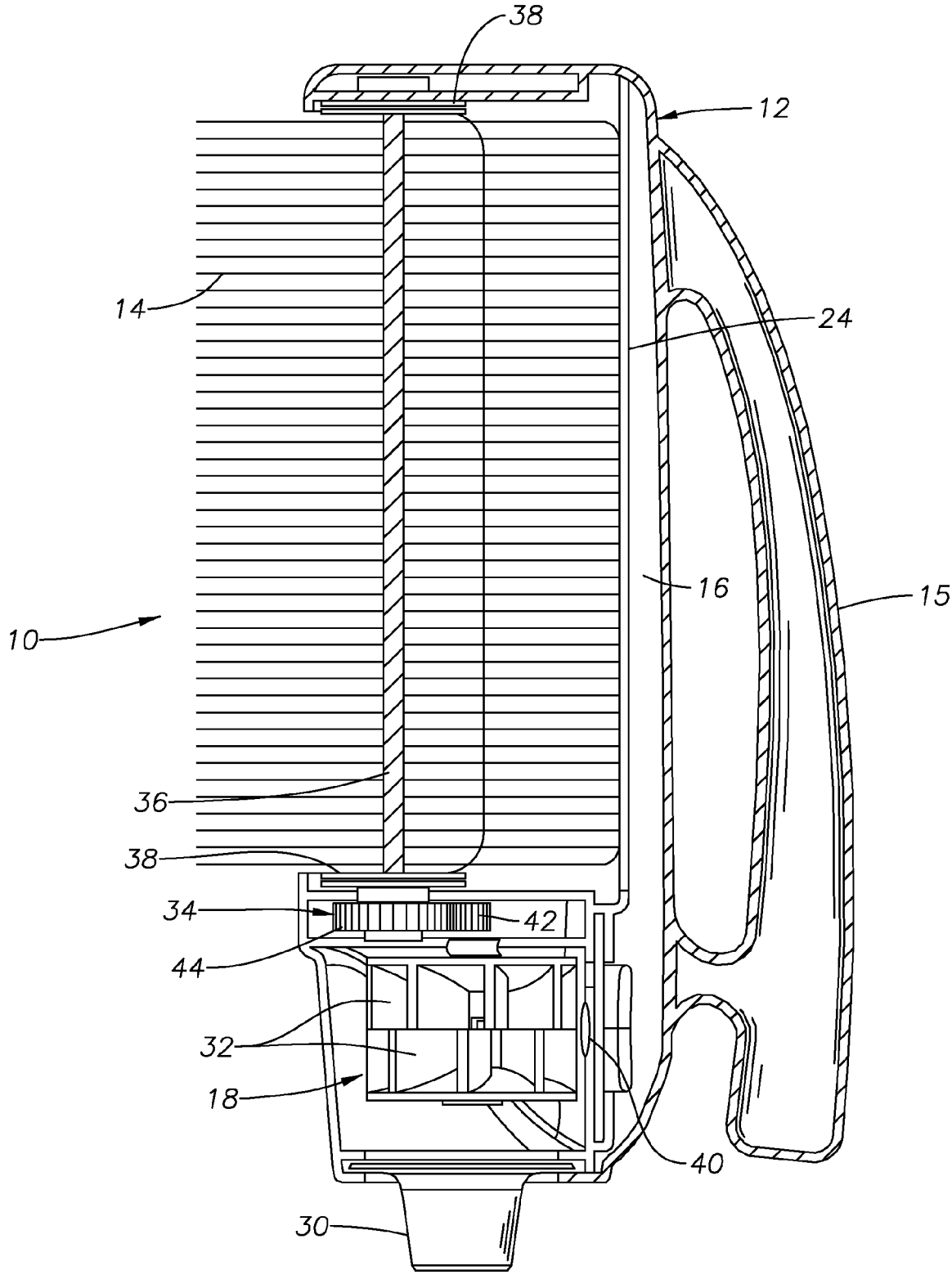
FIG. 3 is a cross-sectional side view of the dust wand of FIG. 1.

FIG. 3 shows a longitudinal cross-section of dust wand 10 comprising body 12, brush 14, and handle 15. Suction chamber 16 is integrally formed with body 12 and comprises inlet port 24 that runs the length of brush 14. Hose connector 30 provides a connection point for hose 20 and vacuum 22 that are shown in FIG. 1. Drive system 18 comprises impellers 32 and transmission 34. Shaft 36 of brush 14 is coupled to transmission 34 and rotatably supported on body 12 by bushings 38.

In operation, suction is applied to hose connector 30 by hose 20 connected to vacuum 22 as are shown in FIG. 1. This suction pulls air through inlet port 24 into suction chamber 16. The flow of air then passes through nozzle 40 that directs the flow of air across impellers 32 into hose connector 30. The flow of air across impellers 32 causes the impellers to rotate, which rotates impeller gear 42 of transmission 34. Impeller gear 42 is engaged with shaft gear 44 such that the rotation of impellers 32 causes rotation of shaft 36 and brush 14. In certain embodiments, transmission 34 is configured so as to rotate brush 14 at a lower rate of rotation than impellers 32. In one example, impellers 32 may rotate at approximately 10,000 revolutions per minute while brush 14 rotates at approximately 3,000 revolutions per minute.

Each rotation of brush 14 brings the tips of the brush bristles into contact with contacting edge 26 and contacting surface 28 of suction chamber 16. This contact, along with the airflow into suction chamber 16 cleans brush 14 and recharges the electro-static charge on the brush with each completed rotation. As dust and other material are picked up by brush 14, those materials are carried to inlet port 24, where the material is dislodged from the brush and pulled into suction chamber 16. The dust and other material from brush 14 is drawn through suction chamber 16 and nozzle 40, across impellers 32, and through hose 20 to vacuum 22.

Figure 4:
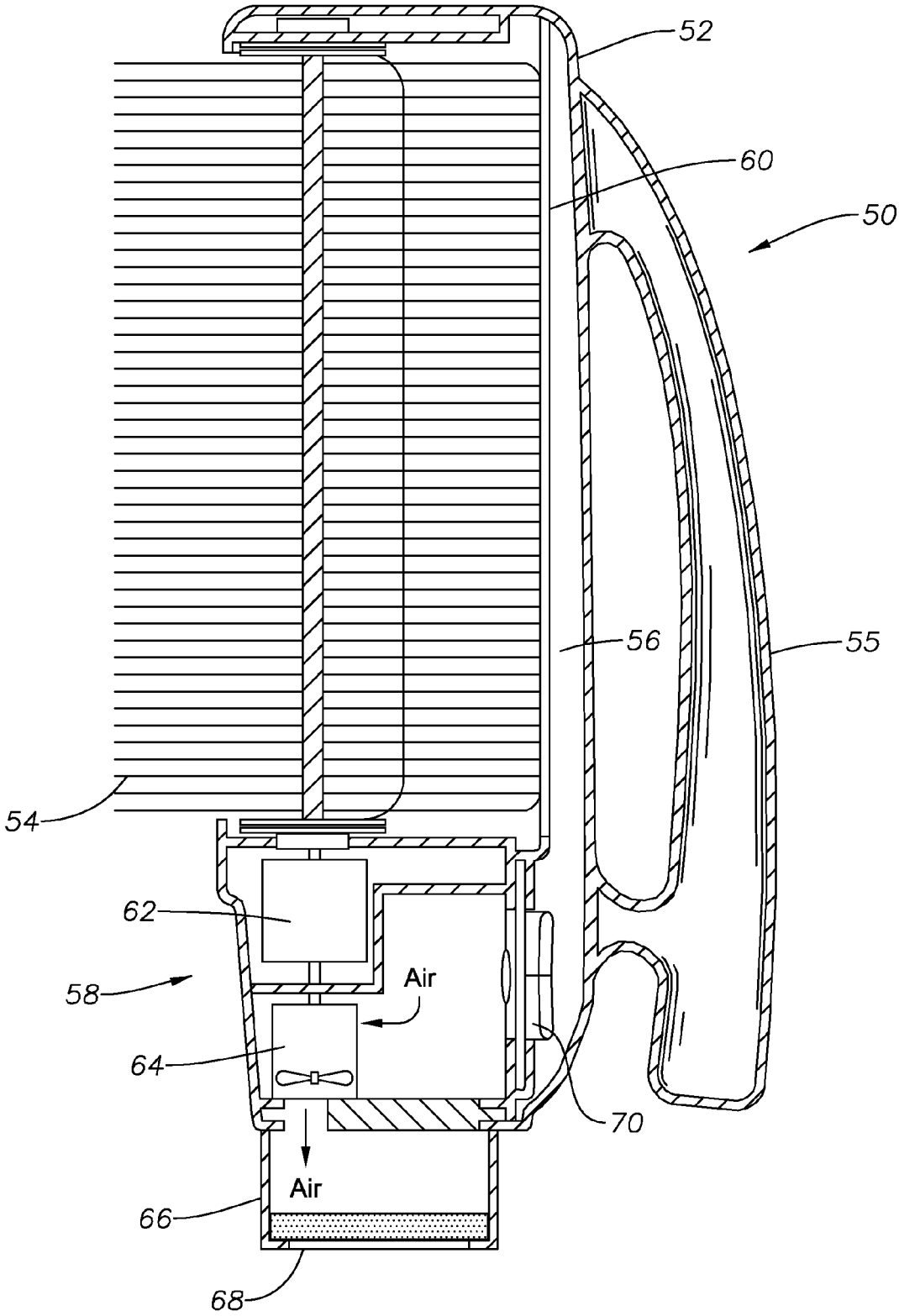
FIG. 4 is a cross-sectional side view of a rotating dust wand constructed in accordance with embodiments of the present invention.

Referring to FIG. 4, dust wand 50 comprises body 52, brush 54, and handle 55. Body 52 encloses suction chamber 56 and drive system 58. Suction chamber 56 comprises inlet slot 60 and outlet nozzle 70. Drive system 58 comprises electric motor 62, blower 64, collection bin 66, and filter 68. Electric motor 62 is operatively coupled to brush 54 and is powered by an external power source or an internal power source, such as a battery.

In operation, electric motor 62 rotates brush 54 and blower 64. The rotation of blower 64 creates an airflow that draws air through slot 60 into suction chamber 56. The air flows through outlet nozzle 70, through blower 64, and into collection bin 66. As the air moves out of collection bin 66 it passes through filter 68 so that dust particles and other materials are retained within collection bin 66. As is described relative to brush 14 in FIG. 2, the rotation of brush 54 collects dust and other materials from a surface and transfers that material through slot 60 into suction chamber 56. Contact between brush 54 and body 52 creates an electro-static charge that helps in the collection of particles. Each rotation of brush 54 collects particles, deposits those particles into suction chamber 56, and recharges the electro-static charge on the brush. By having dust wand 50 incorporate a self-contained power source, the dust wand is totally portable, reduces the necessity of attaching a vacuum cleaner, makes the dust wand easier to get in to difficult to reach areas and offers the ability of the dust wand to be used where a conventional vacuum cleaner may not be available.

The preferred embodiments of the present invention relate to apparatus for cleaning surfaces and the collection of dust and other material. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A dust wand comprising:

a body having first and second ends and a suction chamber extending therebetween;

a cylindrically shaped brush rotatably disposed between said ends and having a brush radius; and said body having a surface along said suction chamber with a curvature conforming to said brush; wherein said suction chamber further comprises:

an inlet port disposed longitudinally along said surface and adjacent to an outer edge of said brush;

said surface having a first radiused curvature extending to said inlet port with a radius greater than said brush radius and a second radiused curvature extending from said inlet with a radius less that said brush radius; and said second radiused curvature forming a contacting edge on said inlet port that contacts the outer edge of said brush.

2. The dust wand of claim 1 further comprising a nozzle at an outlet of said suction chamber directing airflow to a drive system disposed within said body, wherein said drive system rotates said brush relative to said body.

3. The dust wand of claim 2 wherein said nozzle directs airflow to an impeller coupled to said brush by a transmission, wherein said impeller is rotated by airflow through said suction chamber.

4. The dust wand of claim 3 wherein airflow trough said suction chamber is generated by a vacuum cleaner coupled to said dust wand.

5. The dust wand of claim 1 further including a drive system having an electric motor coupled to said brush.

6. The dust wand of claim 5 further comprising a blower coupled to said electric motor, wherein said blower generates airflow through said suction chamber.

7. The dust wand of claim 6 further comprising a collection bin and a filter, wherein said blower moves air from said suction chamber into said collection bin and through said filter.

8. A dust wand comprising:

a body having first and second ends and a suction chamber extending therebetween;

a brush rotatably coupled to said first and second ends of said body, wherein a portion of said brush contacts said body;

said suction chamber having an inlet poll disposed adjacent to an outer edge of said brush; and an internal nozzle at an outlet of said suction chamber having a flow area smaller than that of the suction chamber and redirecting airflow from the suction chamber to an impeller coupled to said brush by a transmission, wherein said impeller is rotated by the airflow through said internal nozzle to rotate said brush relative to the body.

9. The dust wand of claim 8 wherein said brush is cylindrically shaped having a brush radius and wherein said suction chamber is formed by an inner and outer wall with the inner wall having a central slot with a contacting edge, said contacting edge having a radius that is less than the brush radius, wherein said contacting edge contacts said brush as the outer edge passes adjacent to the inlet port.

10. A method for constructing a dust wand comprising:

forming a body having a suction chamber disposed therein, the suction chamber having inner and outer walls with an inlet port extending longitudinally along the center of the inner wall of said suction chamber to form first and second inner walls, the second inner wall having a longitudinal contacting edge along said inlet port with a radius smaller than a radius of the first inner wall;

rotatably coupling a brush at opposite ends of the body so that an outer edge of the brush is disposed adjacent to said inlet port;

wherein the brush does not contact the first inner wall as the brush rotates toward the inlet and then contacts said contacting edge of the body along the inlet port;

dislodging dust on the brush as the brush engages the inlet port edge; and disposing a drive system within the body, wherein the drive system rotates the brush relative to the body.

11. The method of claim 10 further including an internal nozzle at an outlet of the suction chamber having a flow area smaller than that of the suction chamber and redirecting airflow to an impeller coupled to the brush by a transmission, wherein the impeller is rotated by airflow through the suction chamber.

12. The method of claim 11 wherein airflow through the inlet port of the suction chamber is generated by a vacuum cleaner coupled to the dust wand.

13. The method of claim 10 wherein the drive system comprises an electric motor coupled to the brush and to a blower.

14. The method of claim 13 wherein the blower is housed in the body and generates airflow through the suction chamber.

15. The method of claim 14 wherein the body further includes a collection bin and a filter in fluid communication with the airflow generated by the blower, wherein the blower moves air from the suction chamber into the collection bin and through the filter.

16. A dust wand comprising:

a body having first and second ends and a suction chamber extending therebetween;

a cylindrically shaped brush rotatably disposed between said ends and having a brush radius;

said body having a surface along said suction chamber with a curvature conforming to said brush; wherein said suction chamber further comprises:

an inlet port disposed longitudinally along said surface and adjacent to an outer edge of said brush;

said surface having a first radiused curvature extending to said inlet port with a radius greater than said brush radius and a second radiused curvature extending from said inlet with a radius less that said brush radius;

said second radiused curvature forming a contacting edge on said inlet port that contacts the outer edge of said brush; and a nozzle at an outlet of said suction chamber directing airflow to an impeller coupled to said brush by a transmission, wherein said impeller is rotated by the airflow through said suction chamber to rotate said brush relative to the body.

* * * * *